US008555595B2

(12) United States Patent
Hatzinikolas

(10) Patent No.: US 8,555,595 B2
(45) Date of Patent: Oct. 15, 2013

(54) TIE SYSTEM AND METHOD FOR CONNECTING A CEMENTITIOUS BACKUP WALL MADE IN A PENETRABLE FORM AND A VENEER WALL

(76) Inventor: Michael Hatzinikolas, Edmonton (CA)

( * ) Notice: Subject to any disclaimer, the term of this patent is extended or adjusted under 35 U.S.C. 154(b) by 0 days.

(21) Appl. No.: 13/240,930

(22) Filed: Sep. 22, 2011

(65) Prior Publication Data

US 2012/0005981 A1 Jan. 12, 2012

Related U.S. Application Data

(62) Division of application No. 11/554,207, filed on Oct. 30, 2006, now Pat. No. 8,051,621.

(51) Int. Cl.

| | |
|---|---|
| ***E04B 1/16*** | (2006.01) |
| ***E04B 1/38*** | (2006.01) |
| ***E04C 5/00*** | (2006.01) |

(52) U.S. Cl.

USPC ..... 52/699; 52/698; 52/712; 52/379; 52/562

(58) Field of Classification Search

USPC ..... 52/378–379, 747.1, 702, 698, 508, 513, 52/418, 712–715, 422, 424, 426, 431, 434, 52/579, 570, 562, 565, 568, 410

See application file for complete search history.

(56) References Cited

U.S. PATENT DOCUMENTS

| | | | | |
|---|---|---|---|---|
| 1,924,724 | A | 8/1933 | Olney | |
| 4,150,808 | A | 4/1979 | Sawyer | |
| 4,373,314 | A * | 2/1983 | Allan | 52/434 |
| 4,843,776 | A * | 7/1989 | Guignard | 52/714 |
| 4,869,038 | A * | 9/1989 | Catani | 52/410 |
| 4,869,043 | A * | 9/1989 | Hatzinikolas et al. | 52/712 |
| 5,207,043 | A * | 5/1993 | McGee et al. | 52/379 |
| 5,292,581 | A | 3/1994 | Viazmensky et al. | |
| 5,392,581 | A * | 2/1995 | Hatzinikolas et al. | 52/712 |
| 5,490,366 | A | 2/1996 | Burns et al. | |
| 5,671,578 | A | 9/1997 | Hohmann | |
| 5,816,008 | A * | 10/1998 | Hohmann | 52/565 |
| 6,128,883 | A * | 10/2000 | Hatzinikolas | 52/698 |
| 6,131,360 | A * | 10/2000 | Dalen | 52/712 |
| 6,209,281 | B1 * | 4/2001 | Rice | 52/714 |
| 6,279,283 | B1 | 8/2001 | Hohmann et al. | |
| 6,851,239 | B1 | 2/2005 | Hohmann et al. | |
| 2008/0092472 | A1 * | 4/2008 | Doerr et al. | 52/379 |

* cited by examiner

*Primary Examiner* — Jeanette E. Chapman

(74) *Attorney, Agent, or Firm* — Bereskin & Parr LLP; Kenneth L. Bousfield; Philip Mendes Da Costa

(57) ABSTRACT

A tie system is provided for use with a wall form for a cementitious backup wall and for use with a wall tie to connect between the cementitious backup wall and a veneer. The tie system includes a backup wall connector and a form connector. The form connector is connectable to the form and secures the backup wall connector in position as the wall form is filled.

12 Claims, 6 Drawing Sheets

TIE SYSTEM AND METHOD FOR CONNECTING A CEMENTITIOUS BACKUP WALL MADE IN A PENETRABLE FORM AND A VENEER WALL

This invention claims priority as a divisional of U.S. patent application Ser. No. 11/554,207, filed Oct. 30, 2006 now U.S. Pat. No. 8,051,621 issued Nov. 8, 2011, the specification of which is incorporated by reference herein.

FIELD OF THE INVENTION

This invention relates to a tie system and method for connecting a veneer to a back-up wall. In a particularly embodiment, the invention relates to a tie system and method for connecting a veneer made from bricks or the like to a backup wall made from a cementitious material that is formed using a form made from a penetrable material such a foam material.

BACKGROUND OF THE INVENTION

Certain types of building incorporate a backup wall that is made from a cementitious material and a veneer that may be made from rows of bricks or the like. The cementitious backup wall is sometimes poured on-site into a form that may be made from slabs of foam material.

Connectors are typically used to secure the veneer to the backup wall. However, these connectors sometimes move out of position during the pouring of the cementitious material that makes up the backup wall, thereby potentially impacting their ability to function as desired. For example, the connector may not be properly positioned to secure the veneer in place once the cementitious material cures.

SUMMARY OF THE INVENTION

In accordance with the instant invention, a system and method are provided to secure a veneer to a backup wall constructed from a pourable material. The system includes a form connector that is securable, and preferably removably securable, to a wall form. In accordance with such an embodiment, the form connector is secured in position and may accordingly be used to secure a backup wall connector in place while the pourable material is curing and, more preferably, until the pourable material is cured, or is at least essentially cured. In a particularly preferred embodiment, the form connector secures the backup wall connector in place while the pourable material is placed, e.g., poured into, the wall form and during at least a sufficient portion of the during process such that the backup wall connector is secured in position by the pourable material.

In another embodiment, a wall tie, which is used to secure a veneer to a backup wall, is connected to the backup wall connector with the form connector in position. In such an embodiment, the form connector remains in position when the veneer wall is installed.

In an alternate embodiment, the form connector is removed prior to the veneer wall being installed, thus permitting the form connector to be reused.

In an alternate embodiment, the engagement member that is used to secure the form connector to the backup wall connector is also used to secure the wall tie to the form connector. Such an embodiment is particularly preferred in those embodiments wherein the form connector is removed prior to the veneer wall being installed.

Accordingly, in accordance with one embodiment of the instant invention, there is provided a tie system for use with a penetrable form for a cementitious backup wall and for use with a wall tie to connect between the cementitious backup wall and a veneer, the tie system comprising:

(a) a backup wall connector shaped to extend through an aperture in the form and having:

(i) a forward-facing backup-wall-engagement surface and a rearward-facing backup-wall-engagement surface that are positioned to engage the cementitious material when the backup wall connector extends by a selected amount through the aperture in the penetrable form; and, (ii) a forward-facing form-connector-engagement surface and a rearward-facing form-connector-engagement surface that are positioned to engage the form connector to substantially prevent forward and rearward relative movement between the backup wall connector and the form connector;

(b) a tie connector; and, (c) a form connector connectable to the form.

In one embodiment, the tie system further comprises a forward-facing wall-tie-engagement surface and a rearward-facing wall-tie-engagement surface that are positioned to engage the wall tie to substantially prevent forward and rearward relative movement between the wall tie and the backup wall connector.

In another embodiment, the forward-facing form-connector-engagement surface is the same as the forward-facing wall-tie-engagement surface, and wherein the rearward-facing form-connector-engagement surface is the same as the rearward-facing wall-tie-engagement surface.

In another embodiment, the backup wall connector has a connector aperture defined by a connector aperture wall, wherein the connector aperture wall comprises the forward-facing and rearward-facing form-connector-engagement surfaces.

In another embodiment, the backup wall connector has a connector aperture defined by a connector aperture wall, wherein the connector aperture wall comprises the forward-facing and rearward-facing wall-tie-engagement surfaces.

In another embodiment, the backup wall connector is a substantially planar plate.

In another embodiment, the backup wall connector has at least one opening having a perimeter wall and the forward-facing backup-wall-engagement surface and the rearward-facing backup-wall-engagement surface comprise the perimeter wall.

In another embodiment, the backup wall connector extends other than along a linear axis. For example, the backup wall connector may have an end portion positioned within the cementitious material (when the form is filled) that is bent (e.g. about 90°) of the backup wall connector may be distorted (e.g., S shaped or corrugated) thereby increasing the surface area in contact with the cementitious material and creating a profile the resists the connector from being pulled outwardly from the cured cementitious material.

In another embodiment, the form connector is penetrable to permit a nail to be driven therethrough into the form.

In another embodiment, the form connector is made from a material selected from the group consisting of wood and polymeric material.

In another embodiment, the backup wall connector is shaped to at least substantially prevent leakage of cementitious material out of the aperture in the form.

In another embodiment, the form connector is removable connectable to the form.

In accordance with the instant invention, there is also provided a tie system for use with a penetrable form for a cementitious backup wall comprising cementitious material and for connecting between the cementitious backup wall and a veneer, comprising:

a backup wall connector shaped to extend through the form, the backup wall connector having a length sufficient such that a portion of the backup wall connector is positioned in the cementitious material when the backup wall connector extends by a selected amount through the form and the form is filled, the backup wall connector being configured to inhibit the backup wall connector being pulled outwardly from the cementitious when the cementitious has cured, the backup wall being configured to be engagable with a wall tie; and, a form connector connectable to the form and the backup wall connector.

In another embodiment, the tie system further comprises a wall tie.

In another embodiment, the backup wall connector has a connector aperture positioned to engage the form connector to at least substantially prevent forward and rearward relative movement between the backup wall connector and the form connector.

In another embodiment, the connector aperture is positioned to engage the wall tie to at least substantially prevent forward and rearward relative movement between the wall tie and the backup wall connector.

In another embodiment, the backup wall connector is configured to inhibit the backup wall connector being pulled outwardly from the cementitious when the cementitious has cured by being a substantially planar plate that has at least one aperture in the portion of the backup wall connector that is positioned in the cementitious material. Alternately, the backup wall connector may extend in other than along a linear axis In another embodiment, the form connector is penetrable to permit a nail to be driven therethrough into the form.

In another embodiment, the form connector is removable connectable to the form.

In accordance with the instant invention, there is also provided a method of securing a veneer to a backup wall comprising:

(a) positioning a backup wall connector to extend through a wall form wherein a first portion of the backup wall connector is positioned within the wall form and a second portion of the backup wall connector is positioned exterior to the wall form, the second portion having a form connector engagement member;

(b) securing a form connector to the wall form and the form connector engagement member; and, (c) attaching a wall tie to the second portion.

In one embodiment, the method further comprises filling the wall form with cementitious material and removing the form connector from the wall form and the form connector engagement member prior to attaching the wall tie to backup wall connector.

In another embodiment, the method further comprises constructing the wall form from foam.

In another embodiment, the method further comprises filling the wall form with cementitious material and permitting the cementitious material to cure prior to removing the form connector from the wall form.

In another embodiment, the method further comprises filling the wall form with cementitious material prior to attaching the wall tie to the second portion.

In another embodiment, the method further comprises selecting a backup wall connector wherein the first portion has at least one form-connector-engagement surface.

BRIEF DESCRIPTION OF THE DRAWINGS

For a better understanding of the present invention and to show clearly how it may be carried into effect, reference will now be made, by way of example only, to the accompanying drawings, in which.

DETAILED DESCRIPTION OF THE INVENTION

Figure 1:
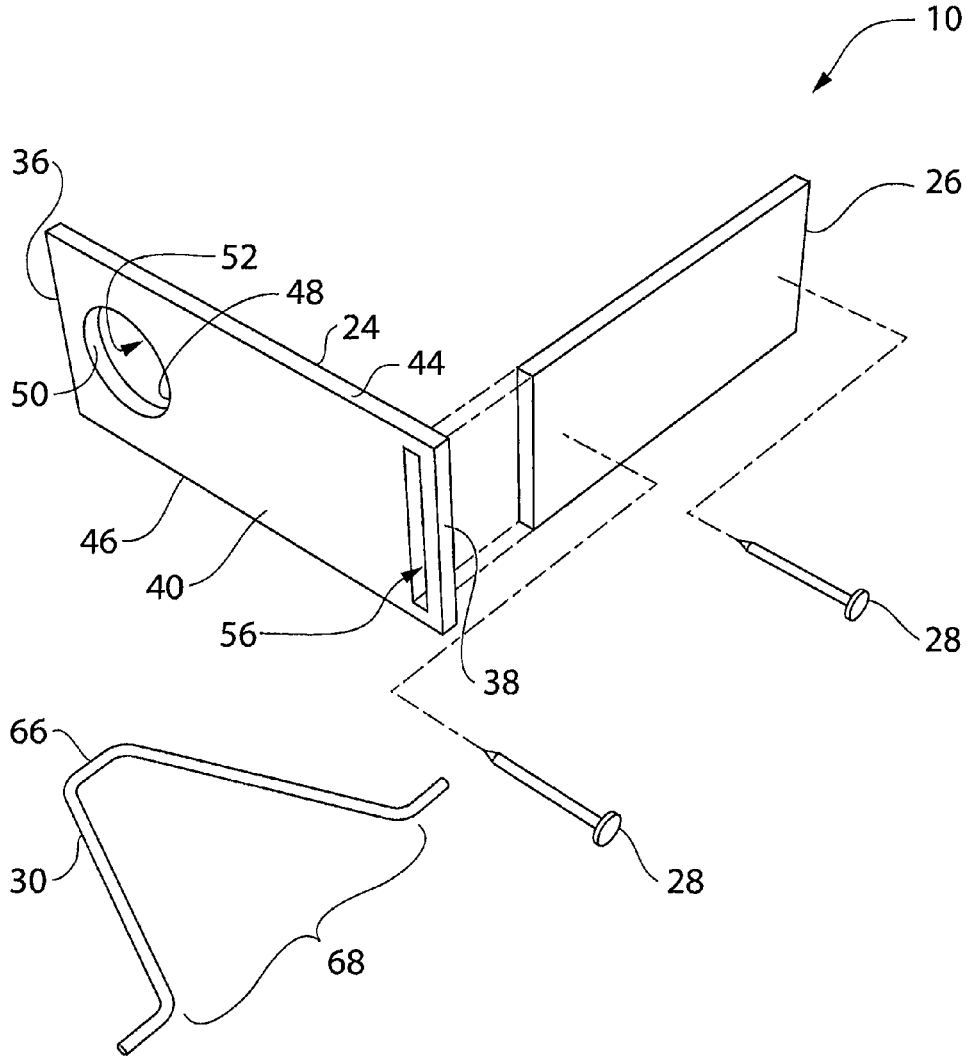
FIG. 1 is a perspective view of the components that make up a tie system in accordance with a first embodiment of the present invention.

Reference is made to FIG. 1, which shows a tie system 10 in accordance with a preferred embodiment of the present invention. The tie system 10 exemplified in FIG. 1 is used to make a final tie assembly 11, exemplified in FIG. 4, for connecting between a backup wall 12 and a wall of veneer 14 in certain types of structures. The backup wall 12 may be made from a cementitious material 16 that is poured in situ into a form 18 made from slabs of a penetrable material 20 such as a polymeric foam material. It will be appreciated that cementitious material 16 may be any fluid cementitious material 16 known in the building industry to fill a wall form 18. It will also be appreciated that form 18 may be made from any material known in the building industry to construct a wall form 18. The veneer 14 may be made from rows of bricks 22 or the like, which may also be referred to as veneer elements 22. It will be appreciated that veneer 14 may be any veneer known in the building industry that is secured to a support by a wall tie.

Figure 4:
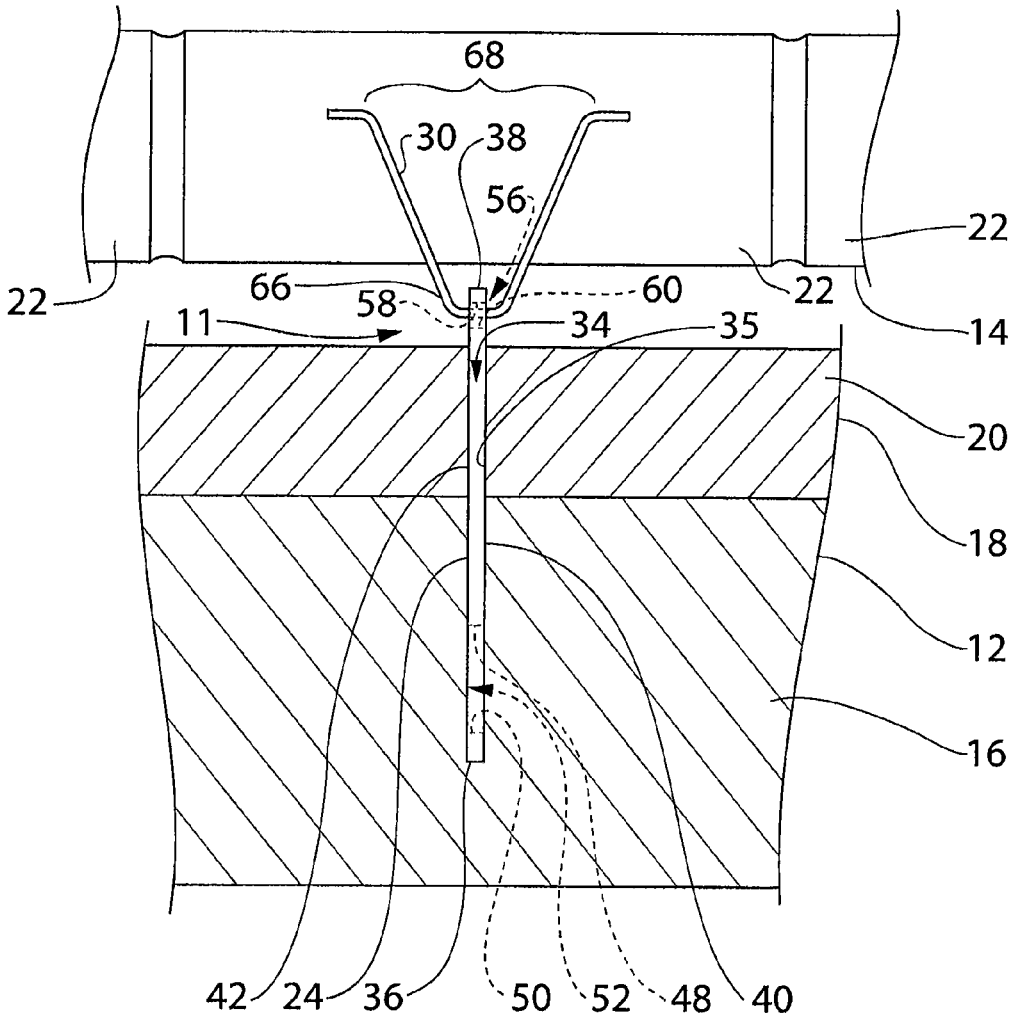
FIG. 4 is a plan view of a final tie assembly made from the components shown in FIG. 1, wherein the final tie assembly connects between the cementitious backup wall shown in FIG. 3 and a veneer.

Referring to FIG. 1, the tie system 10 includes a backup wall connector 24 for connecting to the backup wall 12 (FIG. 4), a form connector 26 for connecting to the form 18 (FIG. 4), one or more fasteners 28 for attaching the form connector 26 to the form 18 (FIG. 4), and a wall tie 30 (FIG. 4).

Figure 2:
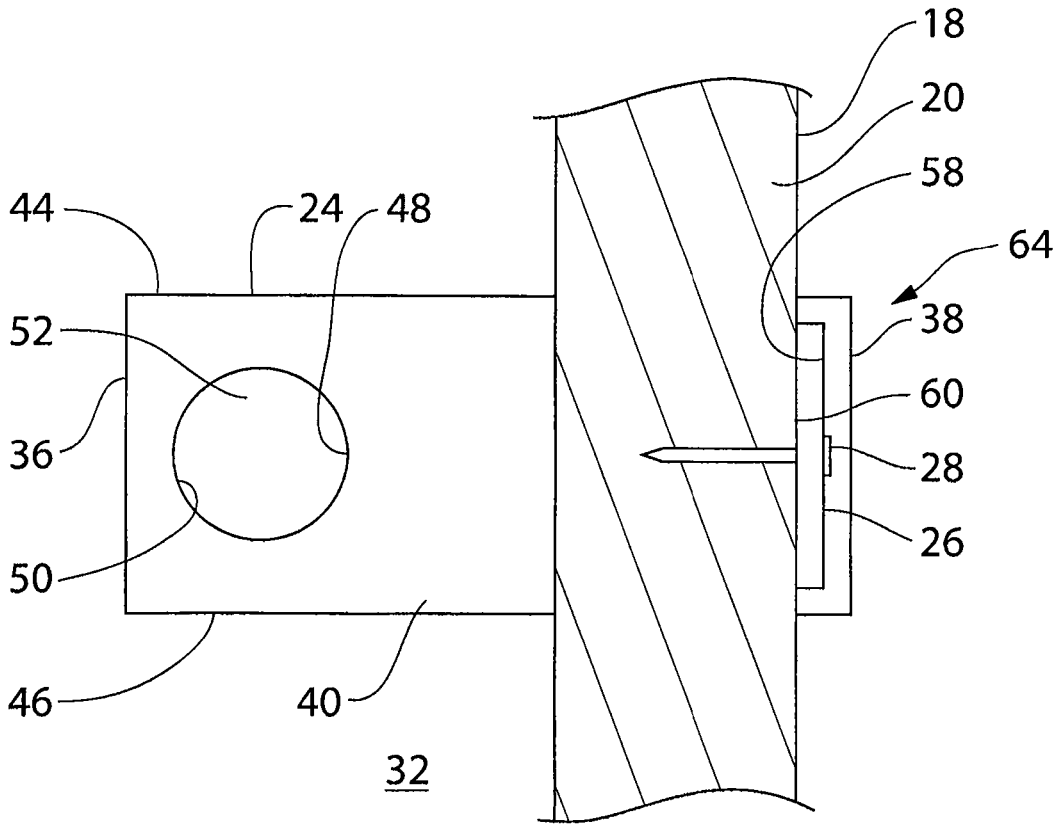
FIG. 2 is a side view of an initial tie assembly made from the components shown in FIG. 1, wherein the initial tie assembly is installed in a form for a cementitious backup wall.

Referring to FIG. 2, the backup wall connector 24 extends through (such as by being pushed inwardly through, slide downwardly through or otherwise inserted) the form 18 into the space shown at 32 that will receive the cementitious material 16 (see FIG. 3) that will make up the backup wall 12 (i.e. the cavity defined by the wall form 18). The backup wall connector 24 preferably has a shape that facilitates penetration of the form 18. For example, the backup wall connector 24 may be a generally planar plate (i.e. sides 40 and 42 may be planar) having a length, a width and a thickness, such that the leading edge face (i.e., the edge face that penetrates the form 18 at forward end 36) is defined by the width and thickness of the plate. It will be appreciated that backup wall connector 24 may alternately have sides 40 and 42 that are not planar, e.g., they may be S shaped, corrugated or have a portion that extends laterally outwardly (e.g. bent laterally). In such an embodiment, backup wall connector 24 may be positioned by sliding backup wall connector 24 downwardly into a slot provided in a wall form.

The plate may be made from corrosion resistant steel, or from some other suitable material having a suitable thickness. Preferably, the backup wall connector 24 does not have any flanges or the like extending outwardly from first and second sides 40, 42. As the backup wall connector 24 is inserted through the form 18 (e.g., by hammering it on its rearward end 38), it creates a form aperture 34 (see FIG. 4). Preferably, the backup wall connector 24 seals with the wall of the form aperture 34, shown at 35 in FIG. 4, to at least substantially prevent leakage of cementitious material 16 out of the aperture 34 in the form 18 prior to the curing of the cementitious material 16. It will also be appreciated that a preformed aperture may be provided in the wall form.

Figure 3:
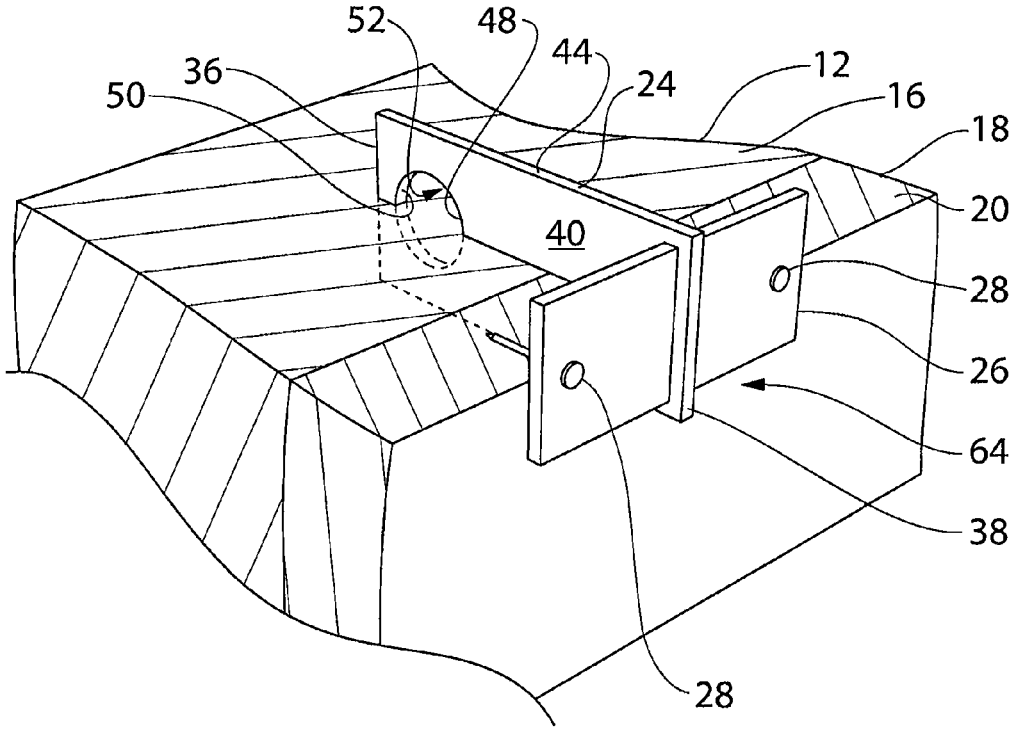
FIG. 3 is a perspective view of the initial tie assembly shown in FIG. 2, shown with the form shown in FIG. 2 and a cementitious backup wall made therein.

It will be understood that a sectional view of the backup wall 12 and the form 18 are shown in FIG. 3 to facilitate illustration of the structure of the backup wall connector 24.

Referring to the back up wall connector 24 exemplified in FIG. 4, the back up wall connector 24 has a forward end 36 (which has the leading edge), a rearward end 38, a first side 40, a second side 42, a top 44 (FIG. 2) and a bottom 46 (FIG. 2). Preferably, the backup wall connector 24 has additional surfaces to abut against the cured cementitious material to assist in retaining backup wall connector 24 in position in the cured cementitious material.

Referring to FIG. 2, such additional surfaces are provided by providing at least one aperture. As exemplified in FIG. 2, proximate the forward end 36, the backup wall connector 24 has a first backup-wall-engagement surface 48 and a second backup-wall-engagement surface 50, both of which are positioned in the space 32 so that they are buried in the cementitious material 16 of the back up wall 12. The first backup-wall-engagement surface 48 is forward-facing in use, and engages the cementitious material 16 (FIG. 3) preferably to prevent movement of the backup wall connector 24 in the forward direction (i.e., into the cementitious material 16). The second surface backup-wall-engagement 50 is rearward-facing and engages the cementitious material 16 preferably to prevent movement of the backup wall connector 24 in the rearward direction (i.e., out of the cementitious material 16).

It is not necessary for the forward-facing surface 48 to face directly forwardly. Thus, it is not necessary for the forward-facing surface 48 to be vertical or to have any portion that is vertical. The forward-facing surface 48 may have any shape that faces forwardly at least somewhat. It may be curved, linear, or a combination of both. Similarly, it is not necessary for the rearward-facing surface 50 to face directly rearwardly and therefore it is not necessary for the rearward-facing surface 50 to be vertical. The rearward-facing surface 50 may have any shape that faces rearwardly at least somewhat, and may be curved, linear or a combination of both.

In the exemplary embodiment shown in FIG. 2, the forward-facing and rearward-facing surfaces 48 and 50 are halves of the wall or perimeter of a backup wall connection aperture 52 formed through the thickness of the connector 24 from the first side 40 to the second side 42 (FIG. 3) proximate the forward end 36 of the backup wall connector 24. In the embodiment shown in FIG. 2, the backup wall connection aperture 52 is closed and is generally circular.

Figure 6:
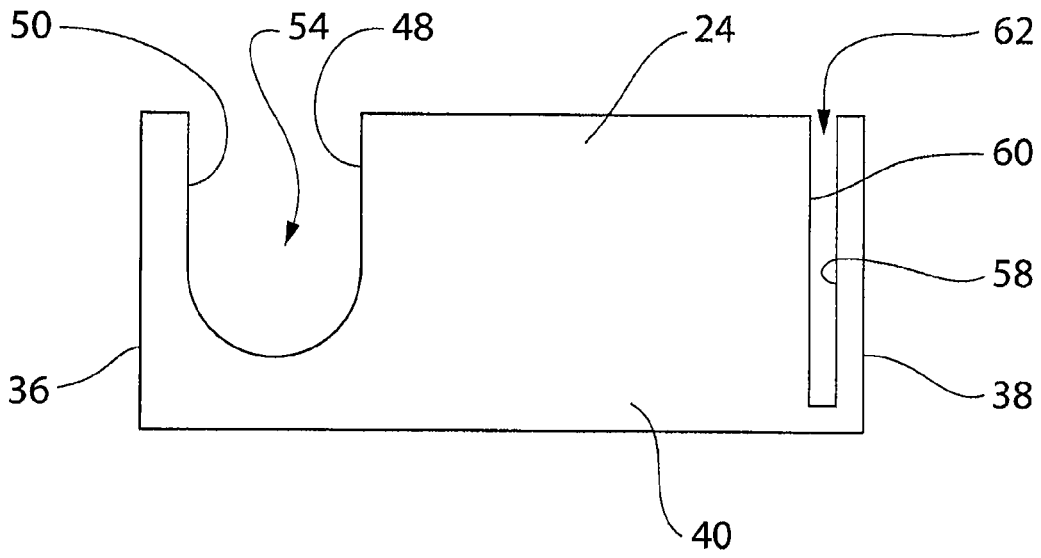

In another exemplary embodiment shown in FIG. 6, the forward-facing and rearward-facing surfaces 48 and 50 are halves of a backup wall connection aperture 54 that is U-shaped and is an open-ended slot. The aperture 54 passes through the thickness of the connector 24 from the first side 40 to the second side (not shown in FIG. 6), proximate the forward end 36.

The backup wall connector 24 may have a plurality of forward-facing surfaces 48 instead of one. The backup wall connector 24 may have a plurality of rearward-facing surfaces 50 instead of one. For example, the backup wall connector may have a plurality of apertures and the apertures may be positioned on any portion of the backup wall connector 24 that will be positioned in the cementitious material 16 when the cementitious material 16 is cured.

In a further alternate embodiment, It will be appreciated that backup wall connector 24 may alternately have sides 40 and 42 that are not planar, e.g., they may be S shaped, corrugated or have a portion that extends laterally outwardly (e.g. bent laterally with respect to the longitudinal axis of backup wall connector 24, i.e. the axis defined by a line passing through forward end 36 and rearward end 38).

Referring to FIG. 1, the backup wall connector 24 has a connecting aperture 56 extending therethrough between the first side 40 and the second side 42 (not shown in FIG. 1) proximate the rearward end 38. The connecting aperture 56 is preferably sized to snuggly receive the form connector 26 (FIGS. 2 and 3) therethrough when initially connecting the back up wall connector 24 to the form 18. Referring to FIG. 2, the connecting aperture 56 has a forward-facing form connector engagement surface 58 and a rearward-facing form connector engagement surface 60. The forward-facing and rearward-facing form connector engagement surfaces 58 and 60 preferably cooperate with the form connector 26 to at least substantially prevent the forward and rearward relative movement between the backup wall connector 24 and the form connector 26, (and therefore between the backup wall connector 24 and the form 18), when the cementitious material 16 is poured into the space 32. It will be appreciated that, in an alternate embodiment, the form connector 26 may be secured to backup wall connector 24 by other means.

The connecting aperture 56 is preferably sized to concurrently or subsequently (i.e., after form connector 26 is removed) receive the wall tie 30 (FIGS. 4 and 5) therethrough. The wall tie 30 is used to connect the backup wall connector 24 to the veneer 14. In this way, the forward-facing and rearward-facing form connector engagement surfaces 58 and 60 may also be referred to as forward-facing and rearward-facing wall tie engagement surfaces 58 and 60 (see FIG. 4). It will be appreciated that, in an alternate embodiment, the wall tie 30 may be secured to backup wall connector 24 by other means and may be of any construction known in the building industry.

Figure 5:
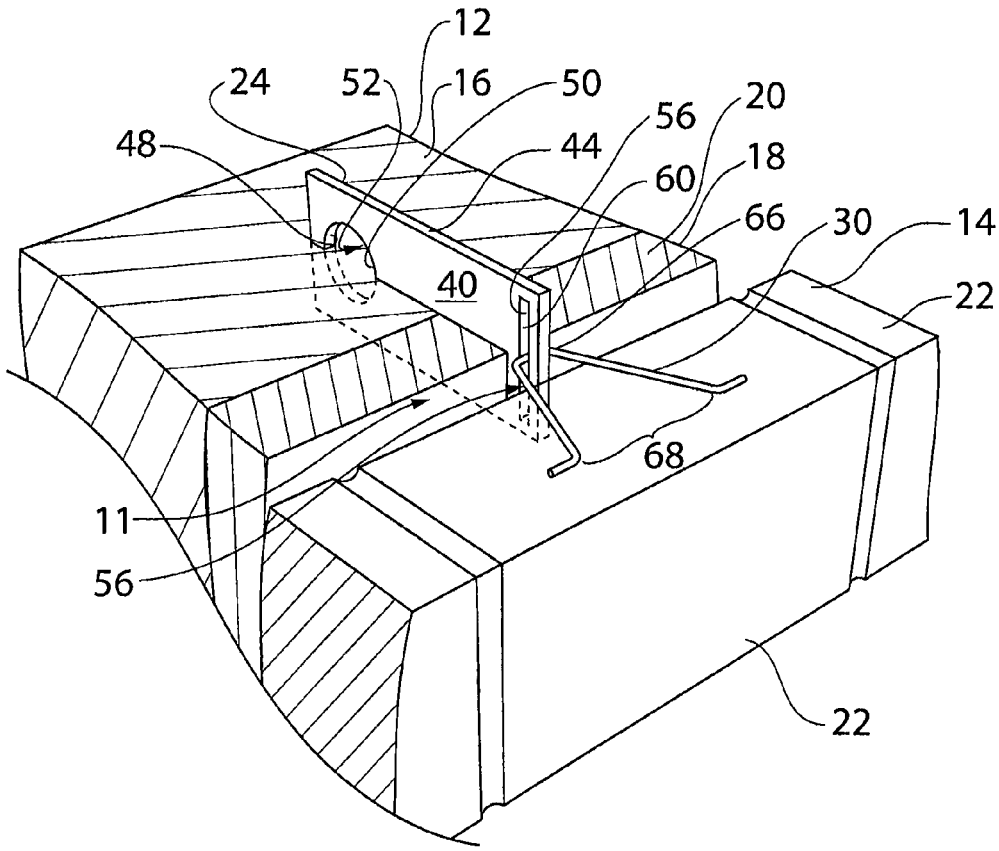
FIG. 5 is a perspective view of the final tie assembly, cementitious backup wall and veneer shown in FIG. 4; and, FIG. 6 is a side view of an alternative backup wall connector to that shown in FIG. 1.

It will be understood that a sectional view of the backup wall 12 and the form 18 are shown in FIGS. 4 and 5 to facilitate illustration of the structure of the backup wall connector 24.

Instead of having a single connector aperture 56, as shown in FIG. 1, for receiving both the form connector 26 and the wall tie 30, it is alternatively possible to provide a backup wall connector that is not shown in the Figures that includes a separate connector aperture for receiving the form connector 26, and a separate connector aperture for receiving the wall tie 30. In such an alternative, the forward-facing and rearward-facing form connector engagement surfaces of the connector aperture for the form connector would be separate from the forward-facing and rearward-facing wall tie engagement surfaces of the connector aperture for the wall tie. In such an embodiment, the form connector 26 may be left in position once the cementitious material cures to a sufficient degree with retain backup connector 24 in position.

The connector aperture 56 is shown in FIG. 1 as being a closed aperture. It is alternatively possible for the backup wall connector 24 to have a connector aperture as shown at 62 in FIG. 6. The connector aperture 62 is open at one end, which facilitates positioning the form connector 26 (FIG. 2) therein and which also facilitates positioning the wall tie 30 (FIG. 4) therein.

Referring to FIG. 2, the form connector 26 connects the backup wall connector 24 to the form 18 and thereby fixes the position of the backup wall connector 24 so that the backup wall connector 24 is not moved inadvertently, or more then a desired amount, during the pouring and curing of cementitious material 16. The form connector 26 may have any suitable shape, but is preferably planar and generally rectangular.

The form connector 26 may be connected to the form 18 in any suitable way. For example, the form connector 26 may be secured to, and preferably removably secured to, the form 18 by fasteners 28 which may be, for example, nails or screws. In this scenario, the form connector 26 may be made from a relatively soft material that is relatively easily penetrated by a nail being hammered therethrough. For example, the form connector 26 may be made from a polymeric material (e.g., plastic), or wood.

The assembly shown in FIGS. 2 and 3, which comprises the backup wall connector 24, the form connector 26 and the fasteners 28, may be referred to as an initial tie assembly 64.

Referring to FIG. 3, after the cementitious material 16 has been poured and has cured sufficiently, the fasteners 28 may be removed from the form 18 and the form connector 26 may be removed from the connector aperture 56.

After removal of the form connector 26 (FIG. 3) from the aperture 56 (FIG. 4), the wall tie 30 may be positioned in the connector aperture 56. Referring to FIG. 4, the wall tie 30 may have any suitable configuration for connecting between the backup wall connector 24 and the veneer 14. The wall tie 30 may, for example, be a generally V-shaped wire or rod, which has a first, closed end 66 and a second, open end 68.

The first end 66 connects to the connector aperture 56. The forward-facing and rearward-facing wall tie surfaces 58 and 60 preferably cooperate with the first end 66 to substantially prevent forward and rearward movement between the backup wall connector 24 and the wall tie 30, and therefore between the backup wall connector 24 and the veneer 14.

The second end 68 of the wall tie 30 connects to the veneer 14 in any suitable way known in the industry. For example, it may be buried in mortar between adjacent rows of veneer elements 22.

Referring to FIG. 5, the connecting aperture 56 is preferably sufficiently tall to provide some freedom of movement over a selected vertical range for the wall tie 30. This permits the height of the wall tie to be adjusted to account for variability in the exact height of, e.g., a row of bricks 22 upon which the second end 68 of the wall tie 30 will rest.

It is preferable for the connecting aperture 56 to be a closed aperture, as shown in FIGS. 1, 2, 3 and 5 to eliminate the risk of the wall tie 30 inadvertently disconnecting from the backup wall connector 24 in the event that one or both of the veneer 14 and the backup wall 12 move vertically relative to the other.

Referring to FIGS. 4 and 5, the assembly comprising the backup wall connector 24 and the wall tie 30 is the final tie assembly 11.

The penetrable form 18 may be made from a polymeric foam material, such as the foam material that it is used currently in slabs to make a form at certain construction sites. Such foam material is penetrable by means such as a nail. Additionally, such foam material can be left in the erected structure to act as an insulation material. It is alternatively possible, however, to make the form out of some other material that is penetrable by a fastener such as a nail.

The structure of the backup wall connector 24 may be selected to permit it to be manufactured inexpensively. For example, the backup wall connector 24 shown in FIG. 1 may be made simply from a rectangular piece of plate material with two apertures therein (i.e., the aperture 52 and the connector aperture 56), such as by stamping.

The structure of the form connector 26 may be selected to permit it to be manufactured inexpensively. For example, the form connector 24 shown in FIG. 1 is simply a rectangular piece of plate material with apertures for fasteners to pass therethrough.

It is possible that the tie system 10 (FIG. 1) may be provided without some of the above described components, with the expectation that the user of the tie system 10 will acquire those omitted components separately. For example, the fasteners 28 may be omitted from the tie system 10 and the user may be expected to provide their own fasteners. As another example, the wall tie 30 may be omitted with the expectation that the customer (i.e., the user) will acquire them or will already have a supply of them. Further, form connector may be a reusable member, i.e., it may be removed prior to wall tie 30 being used.

It will be understood that various modifications and adaptations of the embodiments shown herein can be made without departing from the present invention, the scope of which is defined in the appended claims.

The invention claimed is:

1. A tie system for use with a penetrable wall form for a cementitious backup wall that is prepared from pourable cementitious material that is poured into the wall form and for use with a wall tie to connect between the cementitious backup wall and a veneer, the tie system comprising:

(a) a form connector;

(b) a tie connector; and, (c) a longitudinally extending backup wall connector having first and second opposed longitudinally extending sides that are generally planar and being shaped to extend through an aperture in the wall form, and having a forward-facing form-connector engagement surface and a rearward-facing form-connector engagement surface that are positioned to directly engage the form connector to substantially prevent forward and rearward relative movement between the backup wall connector and the form connector.

2. A tie system as claimed in claim 1, further comprising a forward-facing wall-tie-engagement surface and a rearward-facing wall-tie-engagement surface that are positioned to engage a wall tie to substantially prevent forward and rearward relative movement between the wall tie and the backup wall connector.

3. A tie system as claimed in claim 2, wherein the forward-facing form-connector-engagement surface is the same as the forward-facing wall-tie-engagement surface, and wherein the rearward-facing form-connector-engagement surface is the same as the rearward-facing wall-tie-engagement surface.

4. A tie system as claimed in claim 2, wherein the backup wall connector has a connector aperture defined by a connector aperture wall, wherein the connector aperture wall comprises the forward-facing and rearward-facing wall-tie-engagement surfaces.

5. A tie system as claimed in claim 1, wherein the backup wall connector has at least one opening having a perimeter wall and defining at least one forward-facing backup-wall-engagement surface and at least one rearward-facing backup-wall-engagement surface.

6. A tie system as claimed in claim 1, wherein the backup wall connector extends other than along a linear axis.

7. A tie system as claimed in claim 1, wherein the form connector is penetrable to permit a nail to be driven therethrough into the form.

8. A tie system as claimed in claim 1, wherein the form connector is made from a material selected from the group consisting of wood and polymeric material.

9. A tie system as claimed in claim 1, wherein the backup wall connector is shaped to at least substantially prevent leakage of cementitious material out of the aperture in the form.

10. A tie system as claimed in claim 1, wherein the form connector is removably connectable to the form.

11. A tie system as claimed in claim 1, wherein the form connector is removably receivable in the backup wall connector.

12. The tie system as claimed in claim 1, wherein the form connector is generally planar.

* * * * *